US005588921A

United States Patent [19]

Parsick

[11] Patent Number: 5,588,921

[45] Date of Patent: Dec. 31, 1996

[54] GOLF CLUB

[76] Inventor: Keith Parsick, 585 Bloomfield Ave. Apt. 34, West Caldwell, N.J. 07006

[21] Appl. No.: 534,132

[22] Filed: Sep. 27, 1995

[51] Int. Cl.[6] ..... A63B 53/16

[52] U.S. Cl. ..... 473/299; 473/303; 473/306; 473/314; 473/316; 473/295

[58] Field of Search ..... 273/81.4, 81 B, 273/81 R, 80.1; 473/295, 298, 299, 300, 303, 306, 314, 316

[56] References Cited

U.S. PATENT DOCUMENTS

| | | | |
|---|---|---|---|
| 2,298,505 | 10/1942 | Ottman | 273/81.4 |
| 3,524,646 | 8/1970 | Wheeler | 273/80.1 X |
| 4,537,403 | 8/1985 | Farina | 273/81.4 X |
| 4,679,971 | 7/1987 | Hull | 273/81 B X |

FOREIGN PATENT DOCUMENTS

| | | | |
|---|---|---|---|
| 1195916 | 5/1959 | France | 273/81.4 |

*Primary Examiner*—George J. Marlo
*Attorney, Agent, or Firm*—Pollock, Vande Sande & Priddy

[57] ABSTRACT

A golf club including a golf club shaft having a cylindrical shaft portion with a first end and a second end. The first end of the cylindrical shaft portion may be attached to a golf club head. The golf club shaft also includes a flattened handle portion in the vicinity of the second end of the cylindrical shaft portion and integral with the cylindrical shaft portion. The flattened handle portion is flattened in a plane extending in a direction parallel to a direction faced by a golfer addressing a golf ball to be hit by the golf club. The flattened handle portion has a thickness in a direction parallel to the plane at least three times the thickness of the flattened handle portion in a direction perpendicular to the plane. A golf club head is attached to the golf club shaft in the vicinity of the first end of the cylindrical shaft portion.

15 Claims, 3 Drawing Sheets

GOLF CLUB

BACKGROUND OF THE INVENTION

1. Field of the Invention

The present invention relates to golf clubs, and in particular, to a club having an asymmetric handle.

2. Description of Related Art

A high degree of skill and accuracy is required to successfully swing a golf club. Much has been written about the proper method of holding the handle of a golf club. The finger positions must be precise to avoid misalignments that can cause a golf ball to follow an undesirable trajectory. Conventional round golf club handles do not assist the golfer in determining where to position the palms and fingers in order to permit an efficient and powerful arm, shoulder and body movement.

U.S. Pat. No. 4,537,403 shows a putter having a flat shaft supporting a flat handle with rounded corners. The handle, shaft and putter head all lie in the same plane. This design is focused on improving putting and therefore has specialized features that are inappropriate for a club designed to hit a ball into flight. The face of the putter head is vertical and the putter handle has spherical depressions on both sides of the handle designed to position the "node" of the forefinger. This arrangement produces a grip that is looser and quite different from the grip appropriate for a club used to drive a ball into flight.

U.S. Pat. No. 1,677,099 shows a handle for a driver. The cross-section of the handle is semi-elliptical with a flat surface facing toward the club head. This shape feels essentially cylindrical in the back and flat in the front and does not provide a feel appropriate for training a golfer to hold a club correctly.

U.S. Pat. No. 5,169,152 is another handle for a putter. The handle has an elliptical perimeter truncated by a flat surface. This handle is designed to facilitate a radically different method of gripping the putter handle with the hands spaced at opposite ends of the handle. U.S. Pat. Nos. 3,459,426 and 4,067,573 also show putters with handles having radically different shapes designed to allow the golfer to hold the handle with the hands in a "praying" position. See also U.S. Pat. Nos. 4,880,240; 5,037,103; and 5,127,650 for other equipment designed to dramatically alter the way in which a putter is swung.

See also U.S. Pat. No. 3,109,653 showing a putter handle having a flat surface spaced from the central axis of the handle and shaft. There is no teaching of a handle shape useful for teaching the proper grip and feel for a golf club used to place a ball into flight.

Numerous references have described a golf club handle having a surface sculpted to fit the shape of a golfer's hand. These references approximately balance the mass of the handle around a central axis. Thus these references attempt simply to sculpt the generally rounded handle by filling the natural spaces between the hand and the cylindrical handle. See U.S. Pat. Nos. 1,436,579; 1,638,454; 2,046,191; 2,628,100; 4,376,536; 4,511,147; and 5,398,930.

Other golf club handles are shaped as polygonal prism such as the rectangular prism of U.S. Pat. No. 4,215,860, or the pentagonal prism of U.S. Pat. No. 4,629,191. These patents are designed simply to provide flat surfaces to either change the grip or provide physical cues. However, these references again tend to have balanced mass with the mass located to the right and left being approximately the same as the mass to the front and back.

See also Design patent U.S. Pat. No. 194,471 for a golf club handle having a portion of its central axis skewed to the shaft axis. See also U.S. Pat. Nos. 1,639,864; 2,050,554; 3,837,647; 4,189,144; 5,253,868; 5,306,003; and 5,316,299.

SUMMARY OF THE INVENTION

In accordance with the illustrative embodiments demonstrating features and advantages of the present invention there is provided a golf club with a handle having a slat-like shape extending substantially parallel to an orthogonal plane. The club has a shaft, integrated with the handle, which extends parallel to the orthogonal plane. A club head is attached to the shaft and has a striking surface shaped to propel a ball into flight away from the orthogonal plane.

According to a second aspect of the invention there is provided a golf club having a shaft and an axially asymmetric handle. The club also has a shaft and a club head attached to the shaft. The club head is shaped to propel a ball into flight. Also included is a releaseable means for (a) holding the handle on the shaft, and (b) releasing the handle to allow the handle to rotate coaxially with respect to the shaft.

By employing apparatus of the foregoing type, an improved golf club is achieved. In a preferred embodiment, a golf club handle has an asymmetric handle with a slat-like shape. This shape tends to ensure that the golfer's palms face each other with the thumbs positioned near the upper edge and the other fingers curling under the lower edge of the handle. The preferred slat-like handle lies in an orthogonal plane that is perpendicular to the flight path of the golf ball at the moment of impact. Therefore, the length of the club head will extend lengthwise along this same orthogonal plane. From the golfer's viewpoint, the slat-like handle and shaft are shaped much like a paddle and lies in a vertical plane when addressing the ball.

In a preferred embodiment, the handle and club shaft can be molded integrally from the same material. In a simple embodiment, the club shaft is a tapered cylindrical tube, while the handle is primarily a ruler-like prism or slab, which is thinner than the club shaft.

In some embodiments, the thin, ruler-like handle can be covered with an elastomeric or other resilient jacket to improve comfort when gripping. In one highly preferred embodiment, the jacket is ergonomically sculpted to conform to the shape of a golfer's hand. Specifically, a number of finger depressions are molded into the exterior of the club handle to provide a guide for placing the fingers correctly during gripping.

In still another embodiment, there is a rotatable joint between the handle and the shaft to allow one to change the relative angular orientation between the club head and the handle.

BRIEF DESCRIPTION OF THE DRAWINGS

The above brief description, as well as other objects, features and advantages of the present invention will be more fully appreciated by reference to the following detailed description of presently preferred, but nonetheless illustrative embodiments in accordance with the present invention, when taken in conjunction with the accompanying drawings, wherein.

DETAILED DESCRIPTION OF THE PREFERRED EMBODIMENTS

Figure 2:
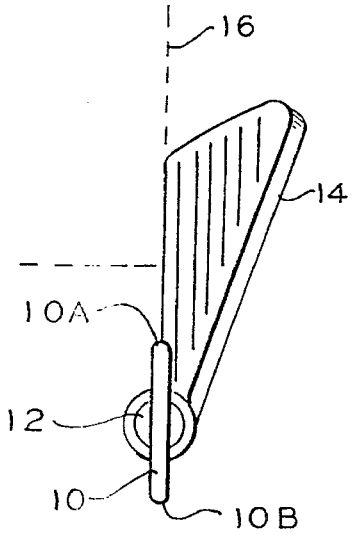
FIG. 2 is an end view of the club of FIG. 1.
Figure 1:
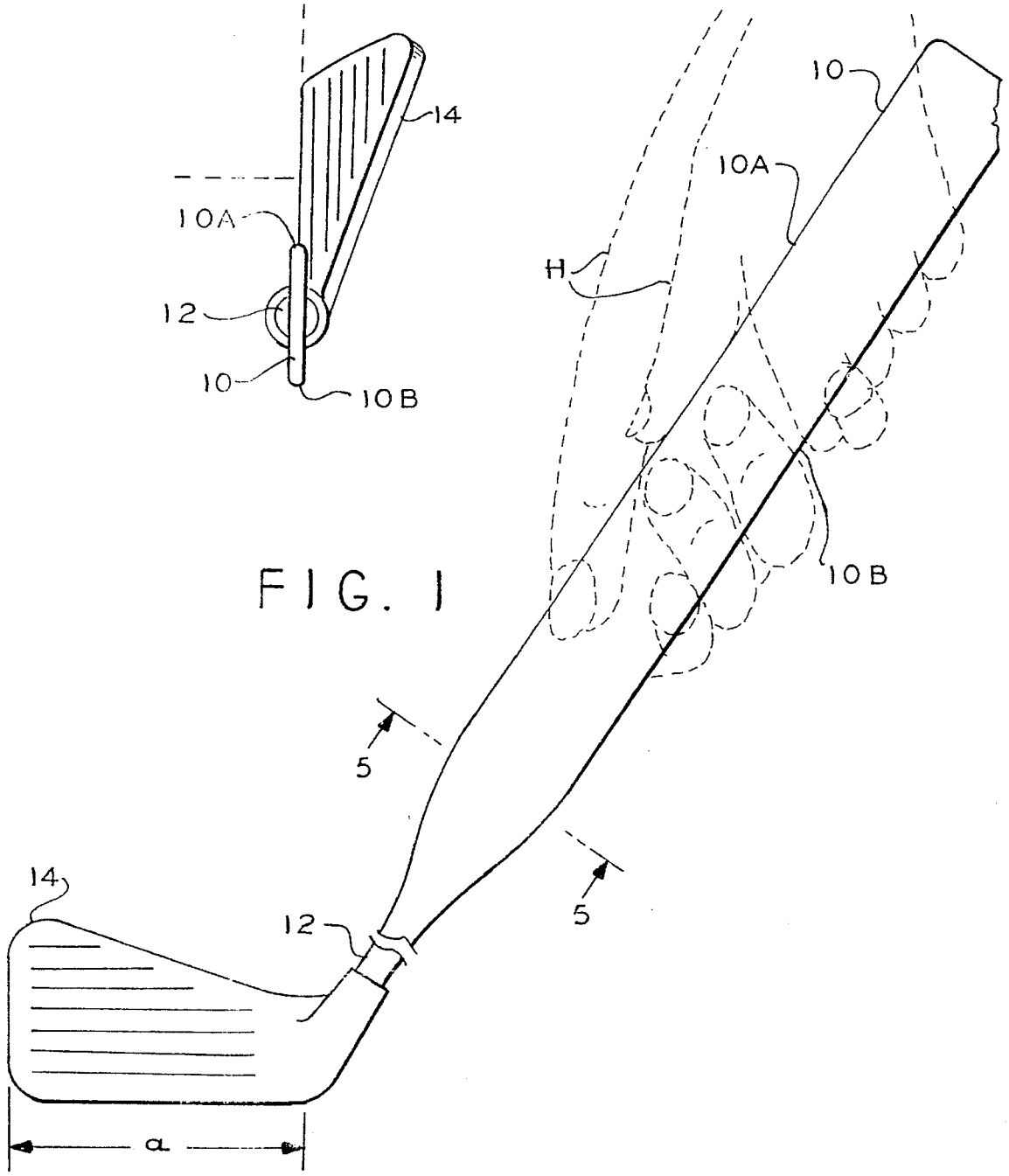
FIG. 1 is a side elevational view of a golf club in accordance with the principles of the present invention with most of the club shaft broken away for illustrative purposes.

Referring to FIGS. 1 and 2 a golf club is shown having an axially asymmetrical handle 10 integrally connected to a tubular shaft 12. Handle 10 is shown with an upper edge 10A and lower edge 10B. Shaft 12 has a rounded and, preferably, cylindrical exterior.

In this embodiment, handle 10 has a slat-like (or ruler-like) shape lying in an orthogonal plane 16, shown on edge in FIG. 2 (that is, the large, flat surfaces of handle 10 are parallel to plane 16). In this embodiment the orthogonal plane 16 will be a nominally vertical plane passing through the center of handle 10 and shaft 12 when a golfer is addressing or hitting a ball. It will be appreciated that an equivalent orthogonal plane could be defined as spaced from and parallel to that illustrated, in which case handle 10 and shaft 12 are not coincident with but are parallel to the orthogonal plane.

Shaft 12 is fitted into club head 14, shown herein as an iron. Still, club head 14 can be one of various types of irons or may be a sand wedge, wood, driver or other type of club head designed with a striking surface for sending a ball (not shown) into flight.

Club head 14 has a predetermined length shown in FIG. 1 as dimension a. Length dimension a is shown extending along (or equivalently, parallel to) the orthogonal plane 16.

Figure 4:
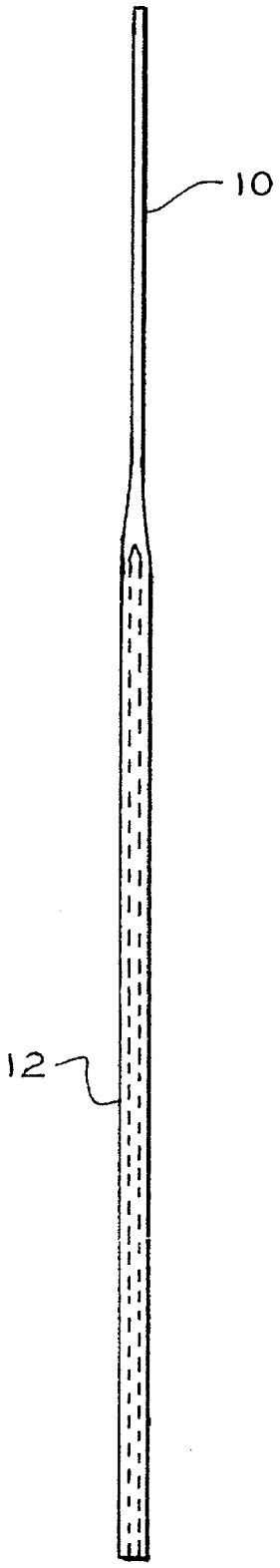
FIG. 4 is an edge view of the structure of FIG. 3.
Figure 3:
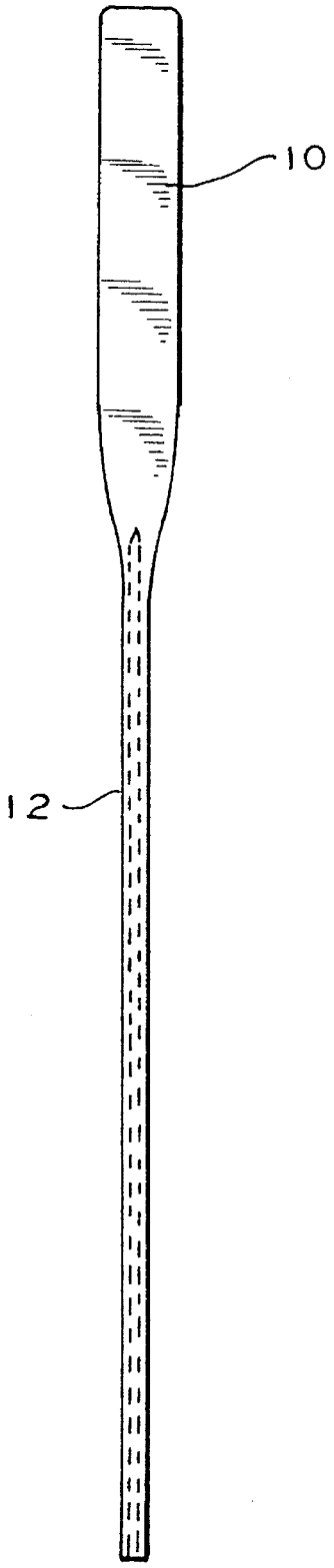
FIG. 3 is a side elevational view of an integral handle and shaft that may be used in the club of FIG. 1.

Referring to FIGS. 3 and 4, previously mentioned shaft 12 is shown integrally molded with handle 10. In this preferred embodiment, the integral unit of FIGS. 3 and 4 is formed from a carbon composite or a carbon/boron composite. In other embodiments this integral unit can be formed of steel, aluminum or other materials.

In one preferred embodiment the shaft 12 had a stiffness that allowed 3° to 7° of deflection for a torque of one foot-pound, although other stiffnesses are contemplated. The overall length of the combined handle 10 and shaft 12, is typical of ordinary golf clubs and may vary between 34 and 48 inches (85.9 and 121.3 cm), with the handle portion being about 10 inches (25.4 cm) long. However the specific lengths chosen will depend upon the golfer (including juniors) and the type of club head being used (iron, driver, wood, etc.)

The size of handle 10 will be determined by the hand size of the golfer, the type of club head, etc. Preferably, the thickness of handle 10 is ⅛ inch (0.32 cm) and with a height of 1⅝ inches (4.11 cm), although these dimensions will vary depending upon the hand size, etc.

Preferably the thickness to height ratio of the handle is at least 3 to 1 and preferably greater than 4 to 1. This ratio will be chosen depending upon the desired tactile effect. A relatively thin handle will provide a higher pressure on the hands of the golfer, thus providing a more positive indication of the positioning of the handle. Thus the golfer will be less likely to position the handle incorrectly with a thin handle. However, a relatively thicker handle having a smaller height to thickness ratio will be more comfortable, since the upper and lower edges of the handle will have a reduced tendency to dig into the golfer's hands.

Figure 5:
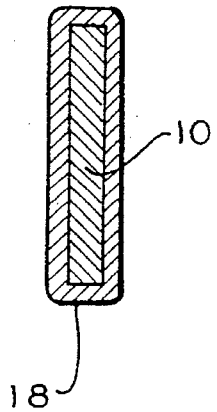
FIG. 5 is a cross-sectional view of the handle, taken along lines 5—5 of FIG. 1.

Referring to FIG. 5, previously illustrated handle 10 is shown encompassed with a resilient jacket 18. Jacket 18 can be made of a rubber or an elastomeric plastic that is either molded around the body of handle 10 or pre-molded as a sleeve that can slip over handle 10.

Figure 6:
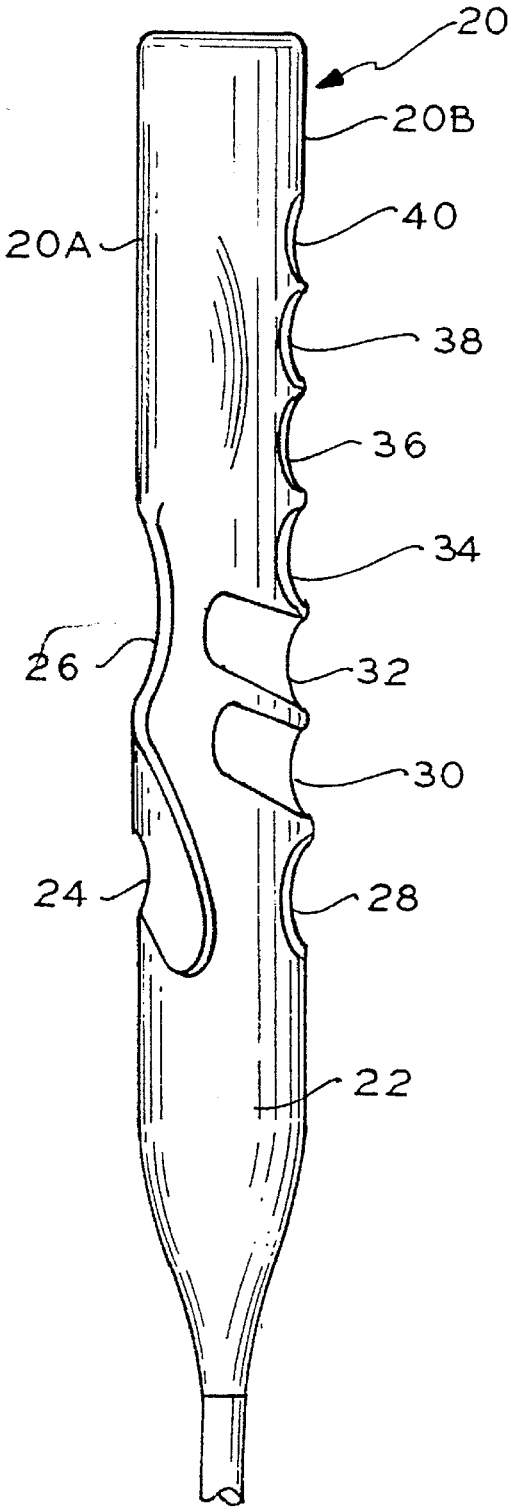
FIG. 6 is a side view of a handle that is an alternate to that of FIG. 1.

Referring to FIG. 6, the handle previously illustrated in FIG. 5 is modified to have an ergonomic jacket 22. Alternatively, the body of handle 20 can be molded to have the contoured surface illustrated in FIG. 6 and be fitted with or without a jacket. Specifically, handle 20 has a plurality of finger depressions 24 through 40, which cross the lower edge 20B of handle 20. These finger depressions are shown for a right handed golfer. A finger depression 24 for the right thumb is shown extending from the upper edge 20A at an angle toward the front of handle 20. Depression 24 is shaped to receive the right thumb.

Positioned behind depression 24 along edge 20A is finger depression 26 for the left thumb. Depressions 28, 30 and 32 are positioned at the lower edge 20B to receive the index finger, middle finger and third finger of the right hand. Depression 34 is positioned similarly and is designed to receive the left index finger. Typically, the left index finger will be overlapped by the right pinky. Alternatively, the left index finger can abut the right pinky (baseball grip) or can interdigitate between the pinky and third finger of the right hand. Depending on the alternate chosen, the finger depressions can be modified accordingly.

Depressions 36, 38 and 40 are designed to receive the middle finger, ring finger and pinky of the left hand. It will be appreciated that depressions 34, 36, 38 and 40 extend primarily on the right side of handle 20. These right portions are therefore not visible in this view, but have an appearance similar to depressions 28–32.

The size and shape of the finger depressions can be altered depending upon the expected hand size of the golfer. Also, in some embodiments the finger depressions can be custom molded by using the golfer's hands as a model.

Figure 7:
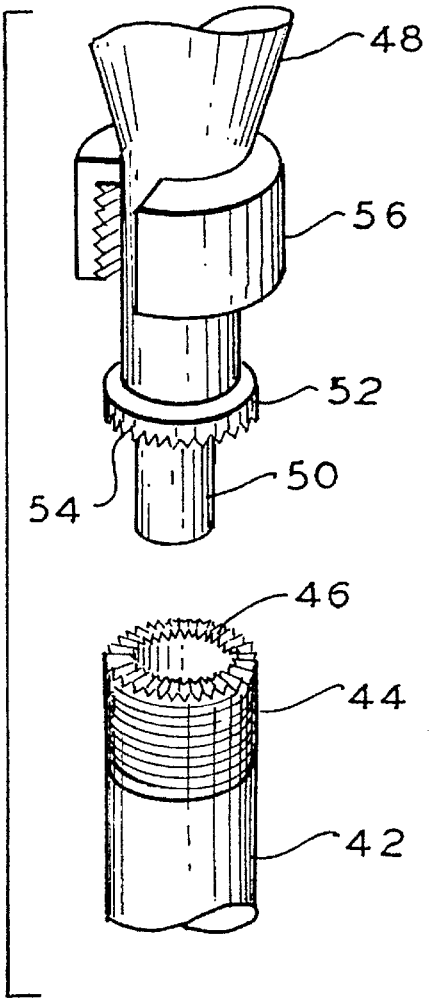
FIG. 7 is a axonometric view of an optional joint that may be used between the handle and shaft of the club of FIG. 1.

Referring to FIG. 7, the illustrated tubular shaft 42 is dimensioned and is structured similar to the previously illustrated shaft (shaft 12 of FIG. 3). The illustrated end 46 of shaft 42 has threads 44. The shaft end shown with a plurality of radially extending ridges 46. The structure associated with ridges 46 and threads 44 at the end of shaft 42 is herein referred to as a tubular shaft member.

A fragment of a handle 48 is illustrated. It will be understood that the portion of handle 48 that is broken away has a shape similar to the handle illustrated in FIGS. 1 or 6. The lower end of handle 48 is formed into a pin 50, essentially a reduced diameter portion of the handle. Handle 48 with its pin 50 can be molded from material similar to that described in connection with FIG. 3, although various alternate materials can be used instead.

Ring 52 is affixed at handle 48 at the transition to pin 50. The structure of handle 48 in the vicinity of pin 50 and ring 52 is herein referred to as a handle member. Ring 52 can be a metal annulus attached to handle 48 in various fashions. The preferred ring 52 is flange-like and has on the side facing ridges 46 a series of matching, radially extending ridges 54.

A collar 56 encircles handle 48 in the vicinity of ring 52. Collar 56 is designed to slip over ring 52 in order to engage the threads 44 of tubular shaft 42. Handle 48 can be attached to shaft 42 by inserting pin 50 inside tubular shaft 42. At this time ridges 54 engage the ridges 46 to angularly set shaft 42 relative to handle 48. Thereafter, collar 56 can be threaded onto threads 44 to lock the ridges 54 of annular flange 52 onto the ridges 46 of shaft 42. The mechanism for releasably locking together ridges 46 and 54 with collar 56 is herein referred to as a release means.

Once assembled, the collar 56 can be loosened to turn the handle 48 relative to the shaft 42. In the context of the embodiment of FIG. 2, this would allow club head 14 to rotate relative to handle 10. If the orthogonal plane 16 remains defined as the plane of handle 10. Thus the length of club head 14 is not necessarily kept strictly parallel to or coincident with the orthogonal plane. Instead, the club head 14 can be rotated from the illustrated position plus or minus 30° and still achieve the advantages of the present invention.

To use the club, the golfer will place hands H on handle 10 as shown in FIG. 1. An important advantage with handle 10 of FIG. 1 is the slat-like or ruler-like shape. The edges of this handle shape give the golfer a definite feel across the hand to confirm that the handle 10 is positioned correctly. Also, the relatively flat opposing surfaces of handle 10 ensure that the palms of hands H are facing each other. Moreover, the ruler-like shape ensures that the golfer cannot hold the handle 10 in an extremely twisted position. The lower edge 10B will feel uncomfortable if located near the center of the palm or near the fingertips.

Once the hands are positioned as shown in FIG. 1, the club can be swung normally. Positioning the hands properly will avoid tendencies to incorrectly roll the wrists or to present the striking surface of the club to the ball incorrectly.

It is to be appreciated that various modifications may be implemented with respect to the above described preferred embodiments. For example, the various dimensions can be altered depending upon the type of club and the height and hand size of the golfer. Additionally, the materials chosen and the stiffness of the various components can be altered depending upon the desired strength, flexibility, etc. Also, the optional rotating joint can be formed of other structures including shafts that are connected together by splines, continuously adjustable clamping devices, etc. Moreover, the various materials chosen may be metals, plastics, elastomers, ceramics or other materials, depending upon the desired strength, flexibility, rigidity, etc.

Obviously, many modifications and variations of the present invention are possible in light of the above teachings. It is therefore to be understood that within the scope of the appended claims, the invention may be practiced otherwise than as specifically described.

I claim:

1. A golf club, comprising: a golf club shaft including:

a cylindrical shaft portion having a first end and a second end, said first end including means for attaching a golf club head to said cylindrical shaft portion, and a flattened handle portion in the vicinity of said second end of said cylindrical shaft portion and integral with said cylindrical shaft portion, said flattened handle portion being flattened in a plane extending in a direction parallel to a direction faced by a golfer addressing a golf ball to be hit by said golf club, said flattened handle portion having a thickness in a direction parallel to said plane at least three times a thickness of said flattened handle portion in a direction perpendicular to said plane; and a golf club head attached in the vicinity of said first end of said cylindrical shaft portion.

2. A golf club according to claim 1, wherein said flattened handle portion has a thickness in a direction parallel to said plane at least four times a thickness of said flattened handle portion in a direction perpendicular to said plane.

3. A golf club according to claim 1, further comprising:

a resilient jacket covering said flattened handle portion of said golf club shaft.

4. A golf club according to claim 3, wherein said resilient jacket includes a plurality of finger-receiving depressions adapted to receive the fingers of a golfer gripping said golf club.

5. A golf club according to claim 1, wherein said flattened handle portion includes an upper edge, a lower edge, and a plurality of finger-receiving depressions adapted to receive the fingers of a golfer gripping said golf club.

6. A golf club according to claim 1 wherein said shaft comprises:

a releaseable means for (a) holding said handle portion on said shaft, and (b) releasing said handle portion to allow said handle portion to rotate coaxially with respect to said shaft.

7. A golf club according to claim 6 wherein said releaseable means comprises:

a handle member affixed to said handle portion and having a plurality of ridges; and a shaft member affixed to said shaft and having a plurality of ridges positioned and sized to interlock with the ridges of said handle member.

8. A golf club according to claim 6 wherein said releaseable means comprises:

a tubular shaft member affixed to said shaft and having a plurality of radial ridges;

a handle member affixed to said handle portion and having (a) a pin sized to fit in said tubular shaft member, and (b) a flange having a plurality of radial ridges positioned and sized to interlock with the ridges of said shaft member; and a collar sized to encompass and lock together said tubular shaft member and said handle member.

9. A golf club shaft, comprising:

a cylindrical shaft portion having a first end and a second end, said first end including means for attaching a golf club head to said cylindrical shaft portion; and a flattened handle portion in the vicinity of said second end of said cylindrical shaft portion and integral with said cylindrical shaft portion, said flattened handle portion being flattened in a plane extending in a direction parallel to a direction faced by a golfer addressing a golf ball to be hit by said golf club, said flattened handle portion having a thickness in a direction parallel to said plane at least three times a thickness of said flattened handle portion in a direction perpendicular to said plane.

10. A golf club shaft according to claim 9, wherein said flattened handle portion has a thickness in a direction parallel to said plane at least four times a thickness of said flattened handle portion in a direction perpendicular to said plane.

11. A golf club shaft according to claim 9, further comprising:

a resilient jacket covering said flattened handle portion of said golf club shaft.

12. A golf club shaft according to claim 11, wherein said resilient jacket includes a plurality of finger-receiving depressions adapted to receive the fingers of a golfer gripping said golf club.

13. A golf club shaft according to claim 9, further comprising:

releasable means for attaching said flattened handle portion on said shaft and releasing said handle thereby permitting said handle to rotate coaxially with respect to said cylindrical shaft portion.

14. A golf club according to claim 13, wherein said releasable attaching means comprises:

a handle member provided on said flattened handle portion and having a plurality of ridges; and a shaft member affixed to said cylindrical shaft portion and having a plurality of ridges positioned and sized to interlock with said ridges of said handle member.

15. A golf club according to claim 13, wherein said releasable attaching means comprises:

a tubular shaft member affixed to said shaft and including a plurality of radial ridges;

a handle member affixed to said handle and including a pin sized to fit in said tubular shaft member and a flange having a plurality of radial ridges positioned and sized to interlock with the ridges of said shaft member; and a collar sized to encompass and lock together said tubular shaft member and said handle member.

* * * * *